US007829825B2

(12) United States Patent
Kühne

(10) Patent No.: US 7,829,825 B2
(45) Date of Patent: Nov. 9, 2010

(54) OVEN AND ITS COMBINATION WITH A STEAM MODULE

(75) Inventor: Johannes Antonius Maria Kühne, Sleeuwijk (NL)

(73) Assignee: Koninklijke Fabriek Inventum B.V., Nieuwegein (NL)

( * ) Notice: Subject to any disclaimer, the term of this patent is extended or adjusted under 35 U.S.C. 154(b) by 780 days.

(21) Appl. No.: 10/558,341

(22) PCT Filed: May 24, 2004

(86) PCT No.: PCT/NL2004/000366

§ 371 (c)(1),
(2), (4) Date: May 24, 2007

(87) PCT Pub. No.: WO2004/104483

PCT Pub. Date: Dec. 2, 2004

(65) Prior Publication Data

US 2007/0272675 A1 Nov. 29, 2007

(30) Foreign Application Priority Data

May 23, 2003 (NL) ..... 1023507

(51) Int. Cl.
*A47J 27/04* (2006.01)
*A21B 1/24* (2006.01)

(52) U.S. Cl. ..... 219/401; 99/468; 126/20

(58) Field of Classification Search ..... None
See application file for complete search history.

(56) References Cited

U.S. PATENT DOCUMENTS

| | | | | |
|---|---|---|---|---|
| 1,958,590 | A * | 5/1934 | Peirce | 219/401 |
| 3,639,725 | A | 2/1972 | Maniscalco | |
| 3,774,008 | A * | 11/1973 | Maniscalco | 219/401 |
| 4,281,636 | A * | 8/1981 | Vegh et al. | 126/369 |
| 6,175,100 | B1 * | 1/2001 | Creamer et al. | 219/401 |
| 6,323,464 | B1 * | 11/2001 | Cohn | 219/401 |

FOREIGN PATENT DOCUMENTS

| | | |
|---|---|---|
| EP | 1016832 | 7/2000 |
| FR | 2398433 A | 2/1979 |
| FR | 2586922 A | 3/1987 |
| FR | 2593587 | 7/1987 |
| WO | WO 03/023285 A | 3/2003 |

* cited by examiner

*Primary Examiner*—Joseph M Pelham
(74) *Attorney, Agent, or Firm*—Marcus C. Dawes; Daniel L. Dawes

(57) ABSTRACT

The invention relates to an oven (1) comprising a preparation space and a device for heating the content thereof, and further provided with means for releasably connecting steam module (18) to the heating device. In this way a convection oven may be converted into a steam oven. The heating device may be arranged in a housing (4), and the connecting means may comprise attachment points (19, 20) arranged on an outer wall of the housing for parts of the steam module (18), like a condenser (31), supply and discharge valves (34, 35) and a pressure sensor (36).

21 Claims, 5 Drawing Sheets

OVEN AND ITS COMBINATION WITH A STEAM MODULE

Figure 1:
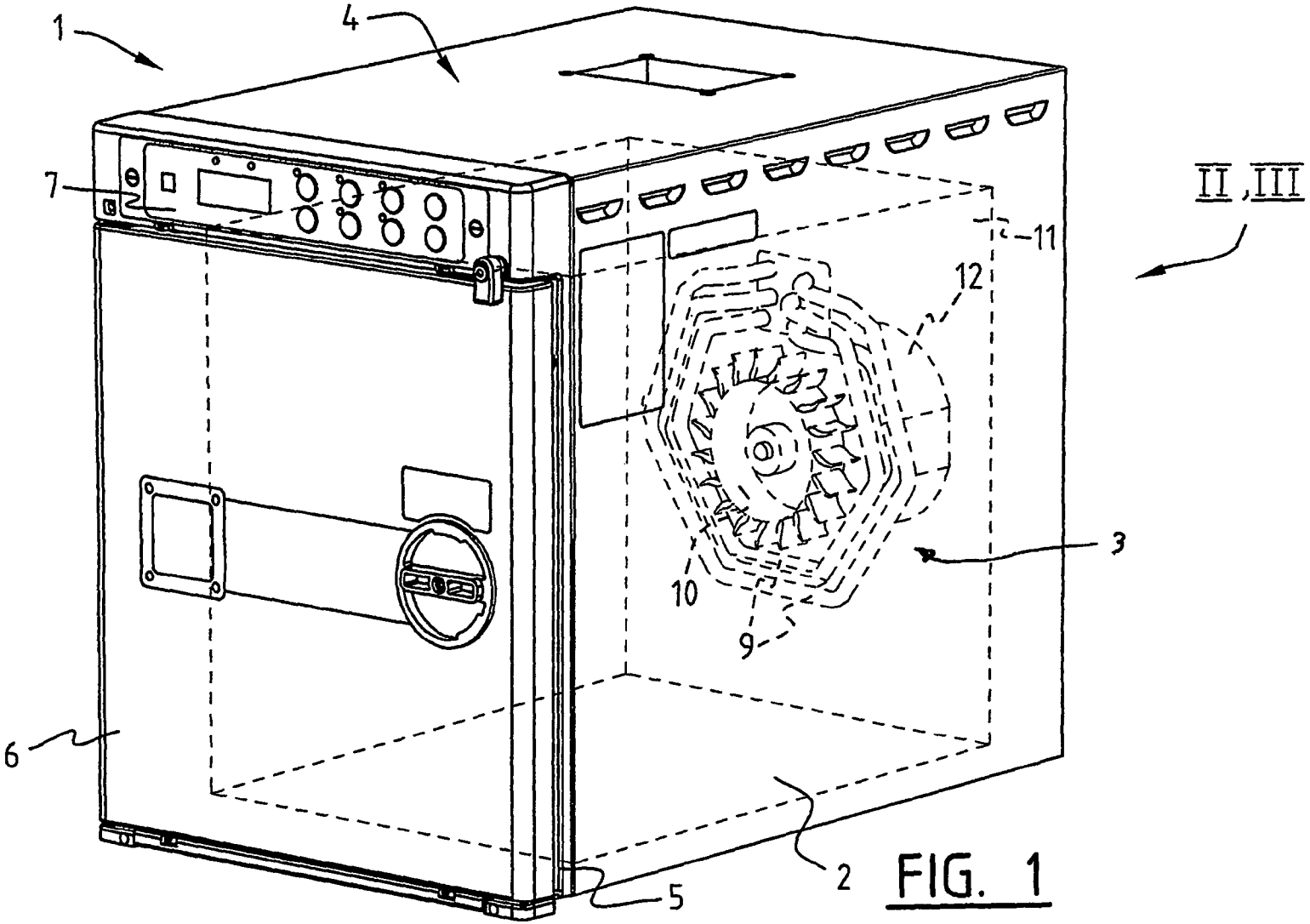

The invention relates to an oven, comprising at least one preparation space and at least one device for heating the contents thereof. Such an oven is generally known. An example is a hot air or convection oven, in which the heating device is formed by one or more heater elements and a fan.

When using such a convection oven the food is placed in the preparation space and the heating device is switched on. This results in the heating element, generally an electrical resistance element, being supplied with current, so that this will glow. At the same time the fan is started. The fan brings about a circulation of air in the preparation space, so that all the time air flows along the glowing heating element and from there back to the preparation space, thereby heating the food present therein.

Another example of such an oven is a gas oven, in which a gas burner is used for heating the air in the preparation space.

A drawback of both the convection oven and the gas oven is that air has only a limited specific heat, so that an intensive circulation of the air is required, but heating of the food takes a relatively long time nevertheless. Moreover the food in the preparation space will dry out somewhat by exposure to hot air.

Therefore, so called steam ovens are known for applications in which the preparation time is of great importance, like for instance in larger passenger aircrafts, where all passengers should be served their meals at the same time. In these steam ovens steam, which is formed by injecting water on heating elements and thus evaporating it, is used for heating. This steam is generally also introduced into the preparation space and led along the food to be heated by means of a fan. Since steam or water vapour has a much higher specific heat than air, and the presence of steam also raises the pressure in the preparation space, food may relatively quickly be brought to the required temperature in this way. The temperature in the preparation space is also more uniform than in a convection oven. Moreover the humidity of the food is maintained in this way, so that the quality of meals prepared in steam ovens is higher, while moreover various meals may be prepared at once, because no transfer of taste occurs.

However, steam ovens have the drawback that they are structurally more complicated than convection ovens or gas ovens, and consequently also more expensive, due to the presence of a water and steam circuit in the oven. Moreover, installing a steam oven requires laying a system of water supply and discharge lines.

In industrial applications, where large numbers of ovens are used, like for instance at airlines operating tens or hundreds of aircraft with ovens, it is not practical to have to work with various types of ovens. The fact is, each meal to be served has to be optimally adapted to the possibilities of the oven, and for each oven an optimum preparation program must be determined for each meal. This is of great importance, since the image that travellers have of an airline is largely determined by the quality of meals on board.

The presence of different types of oven therefore leads to a large variety of meals and preparation programs. A problem with standardizing is that retrofitting steam ovens to aircraft which—usually for economic reasons—were originally delivered with convection ovens entails high costs. However, as already indicated it is often impossible to use only hot air ovens, since a steam oven is necessary or desirable for some applications.

Therefore, the invention has for its object to provide an oven in which the advantages of a hot air oven and those of a steam oven are combined. In accordance with the invention, this object is accomplished in an oven of the type described above by means for releasably connecting at least one steam module to the heating device. By using a releasable steam module that comprises all necessary parts for generating steam in the oven, a hot air oven can be transferred into a steam oven with relative ease.

In order to further facilitate connecting of the steam module when the heating device is arranged in a housing, the connecting means preferably comprise attachment points for the steam module arranged on an outer wall of the housing. In this way the oven does not have to be disassembled completely for the steam module to be connected.

The attachment points may advantageously be formed by brackets arranged on the outer wall and having precisely localized mounting apertures. In this way no milling or cutting operations need to be performed when installing the steam module, and simple assembly operations will suffice. Moreover, the steam module may easily be installed in a predetermined position in this way.

The oven preferably includes at least one attachment point for a condenser of a steam module, at least one attachment point for a supply valve of the steam module, at least one attachment point for a discharge valve of the steam module and/or at least one attachment point for a pressure sensor of the steam module. In this way these parts may be connected to the oven in the correct mutual position. On the other hand, it is of course also conceivable that the various parts of the steam module are arranged in a separate frame, which is then attached to the housing of the heating device.

In order to obviate the necessity of drilling when mounting the steam module, the connecting means preferably comprise a plurality of passage openings for supply and discharge lines of the steam module formed in the outer wall of the housing, as well as closure members cooperating with the passage openings. In this way the passage openings may be preformed and then closed off, until they need to be used for connecting the steam module.

When the oven includes an electrical power supply, the connecting means preferable comprise at least one plug connection for connecting the steam module to the electrical power supply. In this way the need for separate power supplies for the various parts of the steam module is obviated.

When the oven includes a control system, the connecting means are preferably arranged for connecting the steam module to the control system. In this way the operation of the steam module as well may be controlled by the oven control system. In that case the control system may include a control program for heating the content of the preparation space using steam, and may be arranged for switching over to the corresponding control program upon detecting the presence of the steam module. In this way the correct control program corresponding to a specific configuration of the oven is automatically implemented.

In order to be able to detect whether the oven is working as a hot air oven or a steam oven, the connecting means preferably comprise a receiving space connected to the control system for receiving an identification unit associated with the heating device or the steam module.

The invention further relates to a combination of an oven as described above and a steam module.

The steam module preferable comprises at least one water supply line connected to one of the passage openings and at least one steam discharge line connected to another passage opening.

The steam module may also comprise at least one condenser connected to the discharge line and mounted on one of the attachment points, as well as supply and discharge valves arranged in the supply and discharge lines and each mounted on one of the attachment points. These valves may be connected to the electrical power supply of the oven, and may also be controllably connected to the oven control system.

Moreover, the steam module may comprise at least one pressure sensor connected to one of the passage openings and mounted on one of the attachment points. This pressure sensor may be connected for signal generation to the oven control system.

The steam module may also comprise an identification unit arranged in the corresponding receiving space of the oven.

Finally, the invention relates to a steam module that is apparently intended for use in a combination of the type described above.

Figure 2:
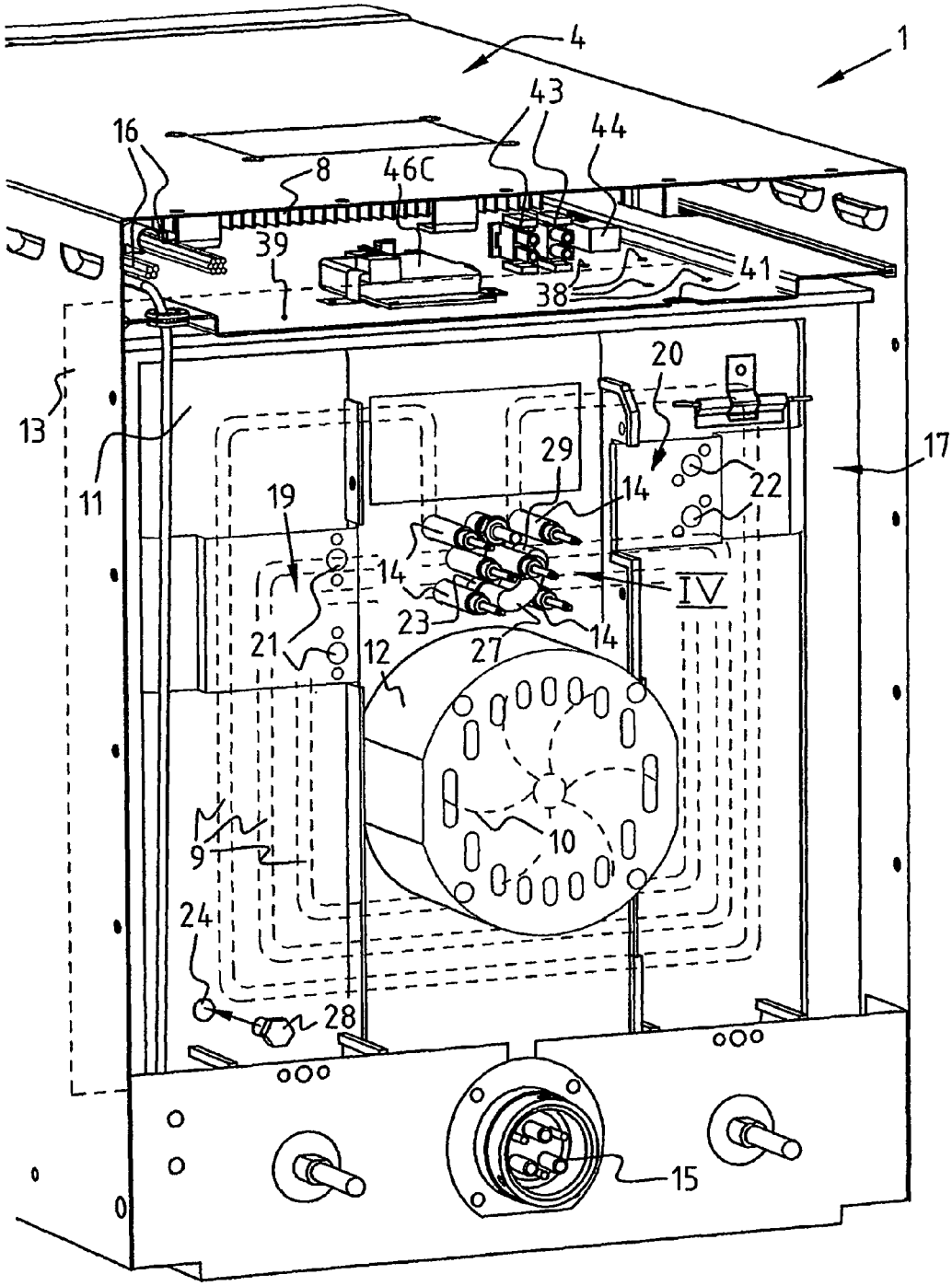
Figure 3:
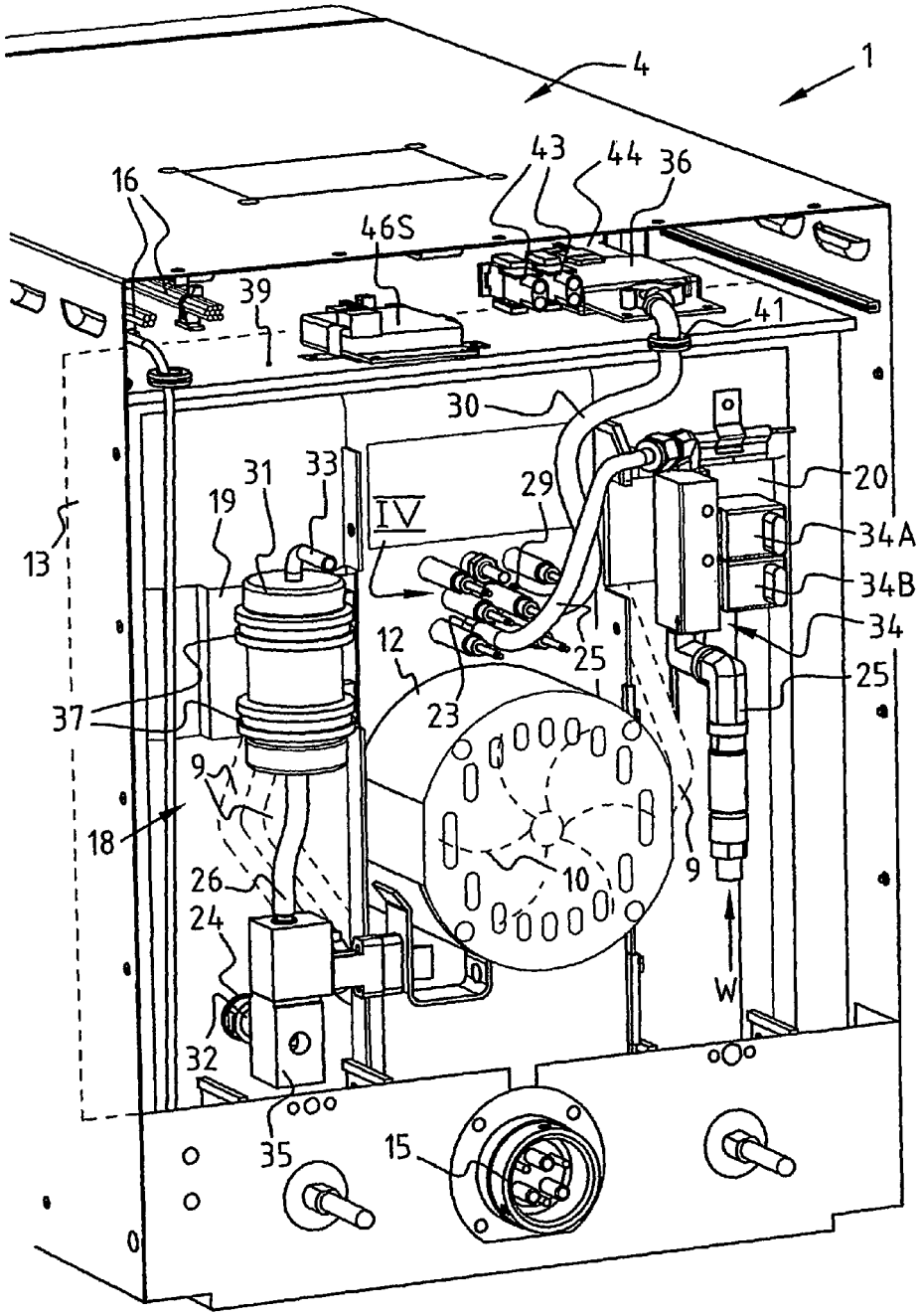
Figure 4A:
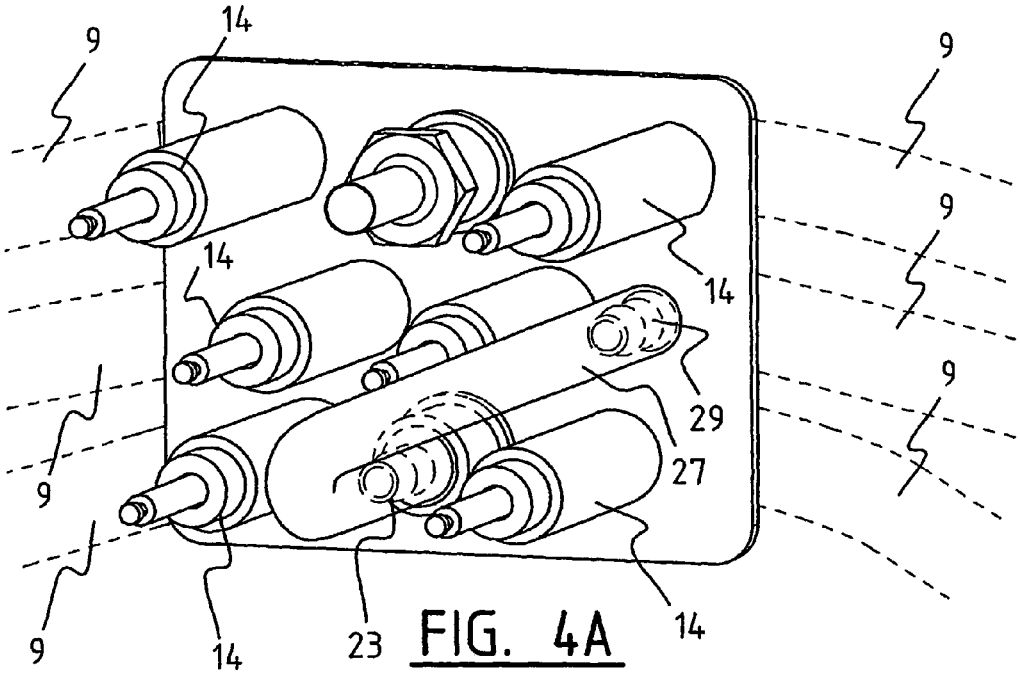
Figure 4B:
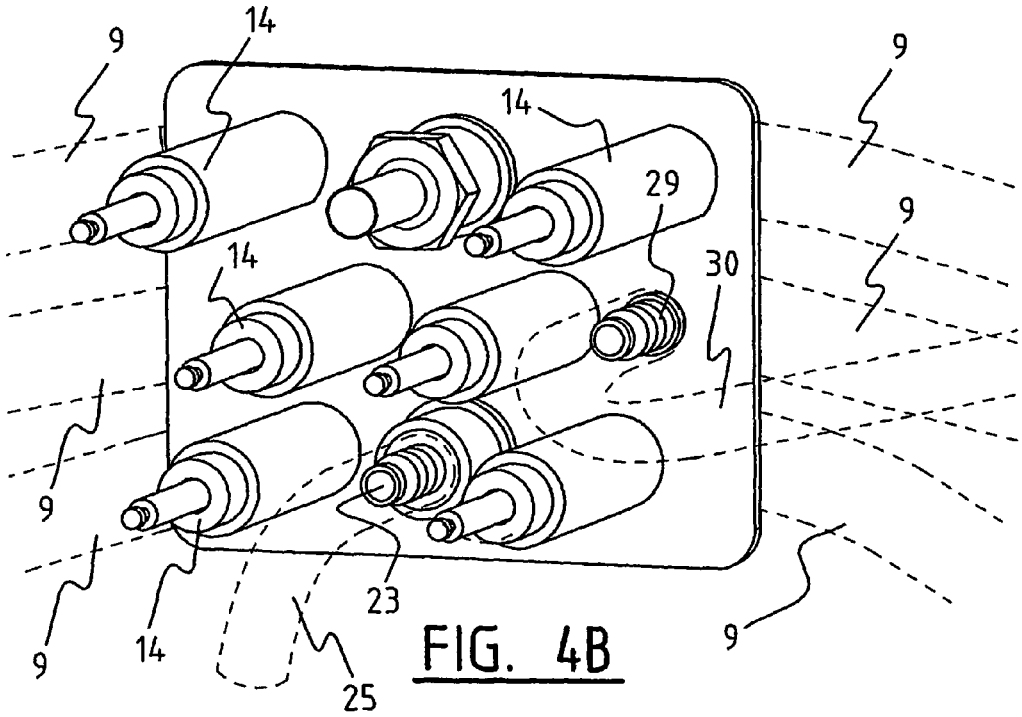
Figure 5:
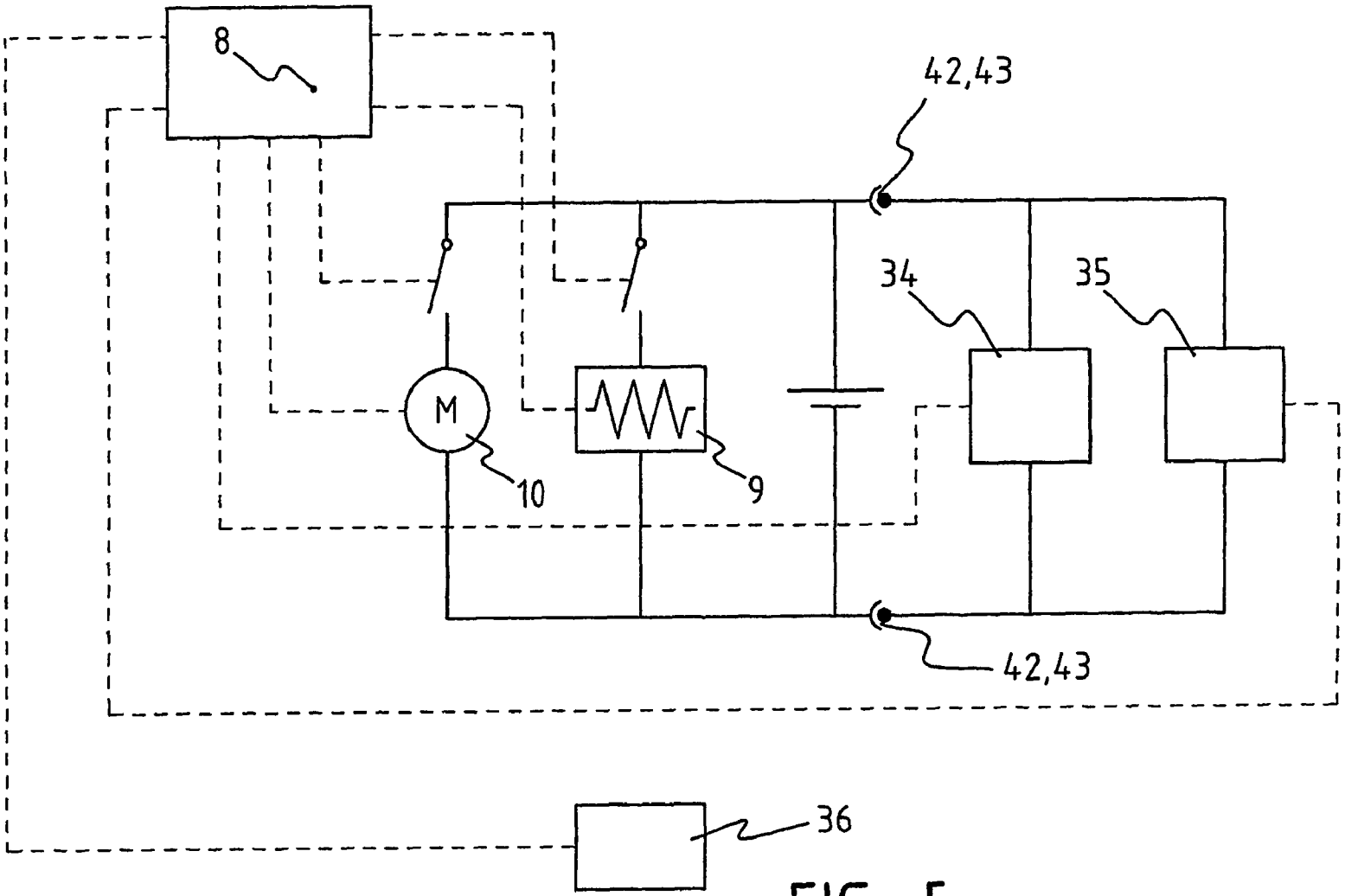

The invention will now be illustrated by way of an exemplary embodiment, with reference being made to the annexed drawing, in which:

FIG. 1 is a perspective view of an oven in accordance with the invention in assembled state, FIG. 2 is a perspective rear view of the oven of FIG. 1 when used as an hot air oven, FIG. 3 is a view corresponding to FIG. 2 of the oven when used as a steam oven, FIGS. 4A and 4B show a detail in accordance with the arrow IV in FIGS. 2 and 3, and FIG. 5 is a schematic diagram showing the connection of the steam module to the electrical power supply and the control system of the oven.

An oven 1 (FIG. 1) includes a space 2 (illustrated in dotted lines) for preparing food and a device 3 connected therewith for heating the contents of the preparation space 2. The preparation space 2 and the heating device 3 are arranged in a housing 4, which has an opening 5 at the front that is closed off by a door. At the front of the oven 1 also a control panel 7 is formed, which is connected with a control system 8 of the oven 1 to be discussed below.

The oven 1 is basically constructed as a hot air or convection oven. To that end the heating device 3 is formed by one or more heating elements 9, in the illustrated embodiment electrical resistance elements, which generate heat when an electric current is led therethrough, and a fan 10 for establishing an air circulation in the preparation space 2, by which the generated heat is distributed and transferred to the food to be prepared.

The heating elements 9 extend along the inside of an end wall 11 of the preparation space 2, while the fan 10 is arranged in a housing 12 that is attached to this end wall 11. In order to avoid direct contact with the heating elements 9, a shield 13 may be placed in front of the end wall 11, like e.g. a gauze or a perforated plate. The heating elements 9 are supplied with electrical current via terminals 14 that protrude through the end wall 11 and that are connected to an electrical system of the oven 1 (not shown here). This system is in turn powered by a grid in the space where the oven 1 is placed, for instance the on-board grid of an aircraft, for which a plug connection 15 is formed at the rear of the oven 1. The fan 10 is supplied by the electrical system of the oven 1 as well.

The operation of the heating elements 9 and the fan 10 is further controlled by the control system 8, which in this case is formed by an electronic circuit board placed above the preparation space 2. To this end the control system 8 is connected to the various parts of the heating device 3 by data lines 16.

In order to allow the oven 1 to be easily converted from a hot air oven into a steam oven, the oven in accordance with the invention is provided with means 17 for releasably connecting a steam module 18 to the heating device 3. In the illustrated embodiment the steam module 18 is arranged for injecting water onto the heating elements 9 so that steam is generated. The connecting means 17 comprise attachment points 19, 20 arranged on the outside of the end wall 11 for the various parts of the steam module 18. In the illustrated embodiment these attachment points 19, 20 are formed by brackets having precisely localised mounting apertures 21, 22.

In this case the connecting means 17 further include two passage openings 23, 24 formed in the end wall 11 of the preparation space 2 for a supply line 25 and a discharge line 26 of the steam module 18, as well as closure members 27, 28 cooperating with these passage openings 23, 24. In the illustrated embodiment a passage opening 29 for a pressure sensing line 30 is further formed. The passage opening 23 for the supply line 25 is formed near the heating elements 9, while the passage opening 24 for the discharge line 26 is formed near the bottom of the preparation space 2. The closure member 28 for this lower passage opening 24 is embodied as a bolt which is screwed into the opening, while the closure member 27 for the passage opening 23 is shaped as a conduit connecting this opening 23 to the sensor opening 29, thus closing both these openings 23, 29 at once.

As stated above, the steam module 18 includes a supply line 25 for supplying water W, which may be supplied by a water mains in the space where the oven 1 is placed, and a discharge line 26 for discharging steam from the preparation space 2 when the pressure becomes to high. A controllable valve 34 controlling the water supply is arranged in the supply line 25. The supply valve 34 is embodied as a double valve, including valve parts 34A and 34B that are closed in their non-actuated state, and of which one is constantly held open during use, while the other is opened in pulsating manner for dose supply of water.

The steam module 18 further includes a condenser 31 in which the steam 2 exhausted from the preparation space 2 is condensed, which is connected to the discharge line 26. A steam pipe 33 is formed at the top of the condenser 31 for venting possibly non-condensed water vapour. A controllable valve 35, which periodically vents steam from the preparation space 2 in order to maintain a constant pressure therein is arranged in the discharge line between the condenser 31 and the passage opening 24.

The steam module 18 finally includes a pressure sensor 36 that is connected to the sensor line 30 and provides a pressure signal, on the basis of which the functioning of the steam module 18, specifically the position of the valves 34, 35 is controlled.

As stated above, the various parts of the steam module 18 are releasably connected to the oven 1 through the connecting means 17. The condenser 31 is mounted in two straps 37 that are screwed fixed into the openings 21 of the bracket 19. The supply valve 34 is also mounted in the openings 22 of the bracket 20 by means of screws. The discharge valve 35 is directly mounted in the passage opening 24 by means of a nipple 32. The pressure sensor 36 is screwed into the predrilled openings 38 in a mounting plate 39 above the preparation space 2, and the sensor line 30 is further mounted in a passage opening 41 in the mounting plate 39.

The various parts of the steam module 18 are also powered and controlled from the oven 1. To this end plug connections 42, 43 and data terminals 44 are arranged at various locations on the end wall 11 and on the mounting plate 39. In this way the controllable valves 34 and 35 are powered and controlled by power supply lines and data lines (not shown here) from the plug connection 43 on the mounting plate 39. The pressure sensor 36 is connected for signal generation to the control system 8 through the data terminal 44 on the mounting plate 39. The way in which the valves 34, 35 are controlled is in fact conventional, in the sense that the releasable connection of the steam module to the oven 1 is irrelevant for the control. This control method consequently does not form part of the present invention, and will not be described in more detail.

The control system 8 may be pre-adjusted to let the oven 1 function as a steam oven. To this end it may also contain one or more programmes for heating food by means of steam, besides one or more programmes for heating food by means of hot air. The control system 8 is advantageously arranged such that it detects the presence of the steam module 18 and automatically switches over to the relevant collection of preparation programmes on the basis of this detection. This may be achieved in a simple manner by providing the oven 1 with an identification unit 46C that is releasably arranged in a space that is connected to the control system 8. By replacing this identification unit 46C, which supplies an identification signal to the control system 8, by a different unit 46S associated with the steam module 18, the presence of the steam module 18 is signalled.

In this way the invention provides a simple way of swiftly converting an oven from a configuration in which it functions for instance as a convection oven to a configuration in which it is a steam oven. Since all parts of the steam module may be attached to the outside of the oven, and mounting and passage openings are already pre-drilled, only simple installation steps need to be performed, for which no highly skilled personnel is necessary.

Although the invention has been illustrated above by way of an exemplary embodiment, it will be clear that it is not limited thereto. In fact, also another type of oven than a convection oven, for instance a gas oven, could be provided with a releasable steam module. Besides, the steam module could have a different structure than shown and described here, including more or differently routed supply and discharge lines, more or other valves, and more or differently embodied pressure sensors. The steam module could also be integrally formed, for instance in its own frame, whereby the frame could be connected to the oven, rather than the separate parts.

Consequently, the scope of the invention is determined exclusively by the appended claims.

The invention claimed is:

1. An oven capable of being combined with a steam module comprising:
- a housing with an outer wall;
- at least one preparation space;
- at least one heating device for heating the contents thereof;
- connecting means for releasably connecting at least one steam module to the heating device; and
- supply and discharge lines of the steam module,
- wherein the heating device is arranged in the housing, and the connecting means comprises attachment points arranged on the outer wall of the housing, and
- wherein the connecting means comprises a plurality of passage openings formed in the outer wall of the housing for the supply and discharge lines of the steam module, as well as closure members cooperating with the passage openings.

2. The oven as claimed in claim 1, where the attachment points are formed by brackets arranged on the outer wall and having precisely localized mounting apertures.

3. The oven as claimed in claim 1 further comprising a condenser of the steam module and where at least one attachment point is provided for the condenser of the steam module.

4. The oven as claimed claim 1 further comprising a supply valve of the steam module and where at least one attachment point is provided for the supply valve of the steam module.

5. The oven as claimed in claim 1 further comprising an outlet valve of the steam module and where at least one attachment point is provided for an outlet valve of the steam module.

6. The oven as claimed in claim 1 further comprising a pressure sensor of the steam module and where at least one attachment point is provided for a pressure sensor of the steam module.

7. The oven as claimed in claim 1 further comprising an electrical power supply, and where the connecting means comprises at least one plug connection for connecting the steam module with the electrical power supply.

8. The oven as claimed in claim 1 further comprising a control system, and where the connecting means is adapted for connecting the steam module to the control system.

9. The oven as claimed in claim 8 where the control system comprises a control program for heating the contents of the preparation space by means of steam, and is adapted for switching to said control program upon detecting the presence of the steam module.

10. The oven as claimed in claim 8 further comprising an identification unit and where the connecting means comprises a receiving space connected to the control system for receiving the identification unit attached to the heating device or the steam module.

11. The oven of claim 1 further comprising a steam module.

12. The oven of claim 11 where the steam module comprises at least one water supply line connected to one of a plurality of passage openings formed in the outer wall of the housing and at least one steam discharge line connected to another one of the passage openings.

13. The oven of claim 12 where the steam module comprises at least one condenser connected to the discharge line and mounted to one of the attachment points.

14. The oven of claim 12 further comprising supply and discharge valves arranged in the supply and discharge lines and each mounted on one of the attachment points.

15. The oven of claim 14 further comprising an electrical power supply and where the supply and discharge valves are connected to the electrical power supply of the oven.

16. The oven of claim 14 further comprising an oven control system and where the supply and discharge valves are controllably connected to the oven control system.

17. The oven of claim 11 where the steam module comprises at least one pressure sensor connected to one of the passage openings and mounted on one of the attachment points.

18. The oven of claim 17 further comprising an oven control system and where the pressure sensor is connected for signal generation to the oven control system.

19. The oven of claim 11 where the steam module comprises an identification unit arranged in the corresponding receiving space of the oven.

20. An oven capable of being combined with at least one steam module comprising:
- a housing with an outer wall;
- at least one preparation space;
- at least one heating device for heating the contents thereof;

connecting means for releasably connecting the at least one steam module to the heating device; and an electrical power supply, wherein the heating device is arranged in the housing, and the connecting means comprises attachment points arranged on the outer wall of the housing, wherein the steam module comprises at least one water supply line connected to one of a plurality of passage openings formed in the outer wall of the housing and at least one steam discharge line connected to another one of the passage openings, and wherein supply and discharge valves are arranged in the supply and discharge lines and are each mounted on one of the attachment points, the supply and discharge valves being connected to the electrical power supply of the oven.

21. An oven capable of being combined with a steam module comprising:

at least one preparation space;

at least one heating device for heating the contents thereof;

a control system; and connecting means for releasably connecting at least one steam module to the heating device;

wherein the connecting means is adapted for connecting the steam module to the control system; and wherein the control system comprises a control program for heating the contents of the preparation space by means of steam, and is adapted for switching to said control program upon detecting the presence of the steam module.

* * * * *